United States Patent [19]

Kanaida et al.

[11] 4,068,632

[45] Jan. 17, 1978

[54] INTERNAL COMBUSTION ENGINE

[75] Inventors: Yoshio Kanaida, Mitaka; Ryuji Kataoka; Kuniji Imai, Chofu, all of Japan

[73] Assignee: Fuji Jukogyo Kabushiki Kaisha, Tokyo, Japan

[21] Appl. No.: 639,158

[22] Filed: Dec. 9, 1975

[30] Foreign Application Priority Data

Dec. 25, 1974 Japan ..... 49-504695

[51] Int. Cl.[2] ..... F02P 5/04

[52] U.S. Cl. ..... 123/117 A

[58] Field of Search ..... 123/117 A, 148 E, 117 R

[56] References Cited

U.S. PATENT DOCUMENTS

| | | | |
|---|---|---|---|
| 2,087,339 | 7/1937 | Arthur | 123/117 A |
| 3,272,191 | 9/1966 | Walker | 123/117 A |
| 3,367,313 | 2/1968 | Bom et al. | 123/148 E |
| 3,603,298 | 9/1971 | Toda et al. | 123/117 A |
| 3,687,120 | 8/1972 | Lenz | 123/117 A |
| 3,809,038 | 5/1974 | Young | 123/117 A X |
| 3,824,972 | 7/1974 | Sattler | 123/117 A X |
| 3,871,341 | 3/1975 | Kalogerson et al. | 123/117 A X |
| 3,938,329 | 2/1975 | Van Basshuysen | 123/117 A X |
| 3,978,831 | 9/1976 | Yoshikawa | 123/117 A |

FOREIGN PATENT DOCUMENTS

| | | | |
|---|---|---|---|
| 1,208,417 | 10/1970 | United Kingdom | 123/117 A |

*Primary Examiner*—Charles J. Myhre
*Assistant Examiner*—Tony M. Argenbright
*Attorney, Agent, or Firm*—Martin A. Farber

[57] ABSTRACT

An internal combustion engine has a vacuum spark timing control system to advance and retard the spark in which the spark is kept retarded until a predetermined time passes after the engine speed exceeds a predetermined reference engine speed that demarcates the high engine speed range from the low engine speed range operations. During the low engine speed range operation the spark is retarded, while during the high engine speed range operation, the spark is advanced.

3 Claims, 2 Drawing Figures

INTERNAL COMBUSTION ENGINE

The present invention relates to an internal combustion engine having a distributor with a vacuum spark timing control system to advance and retard the spark.

A conventional internal combustion engine is equipped with a vacuum spark timing control system by which the spark is retarded at low engine speed so as to reduce toxic components in the exhaust gases, and by which the amount of retardation of the spark is reduced or the spark is positively advanced at high engine speed so as to improve fuel economy and performance. In this sytem if the engine speed fluctuates across a predetermined engine speed that demarcates the high engine speed range from the low engine speed range, gate means for effecting the shift between the low engine speed range spark control and high engine speed spark control will chatter.

An object of the present invention is to provide an internal combustion engine of the above character in which the chattering of the gate means for effecting the shift between high engine speed spark control and low engine speed spark control is prevented.

Figure 1:
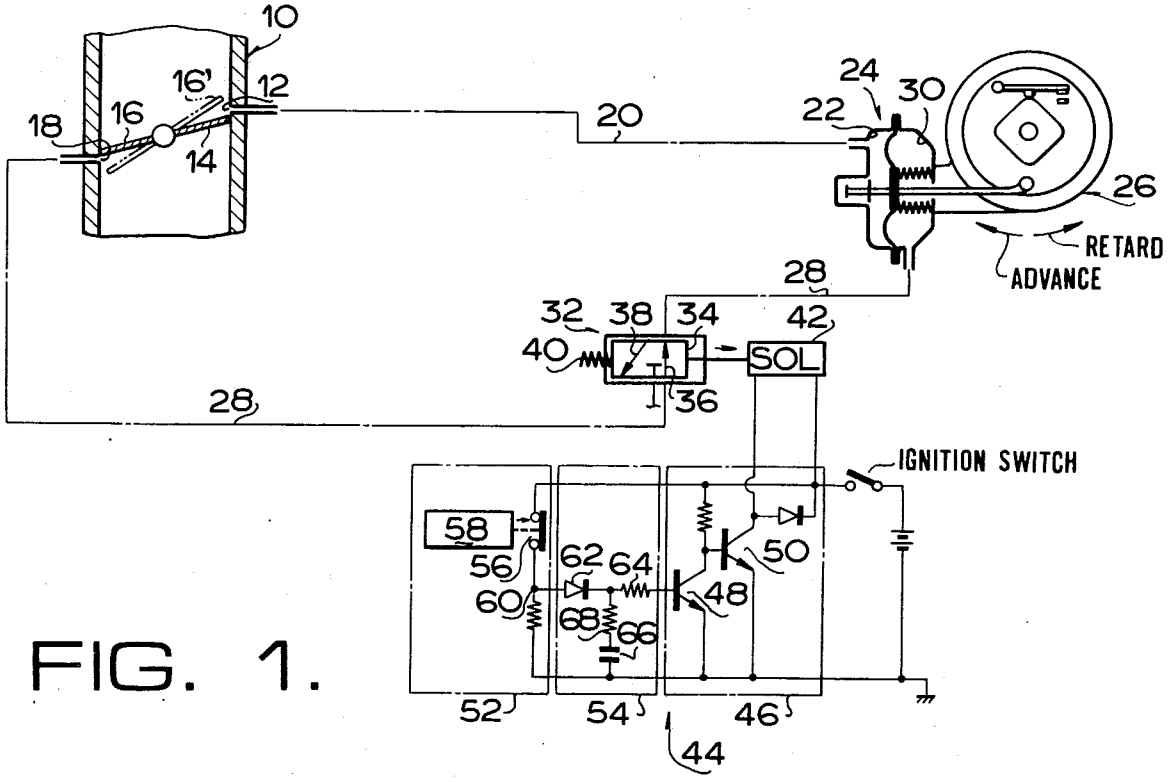
Figure 2:
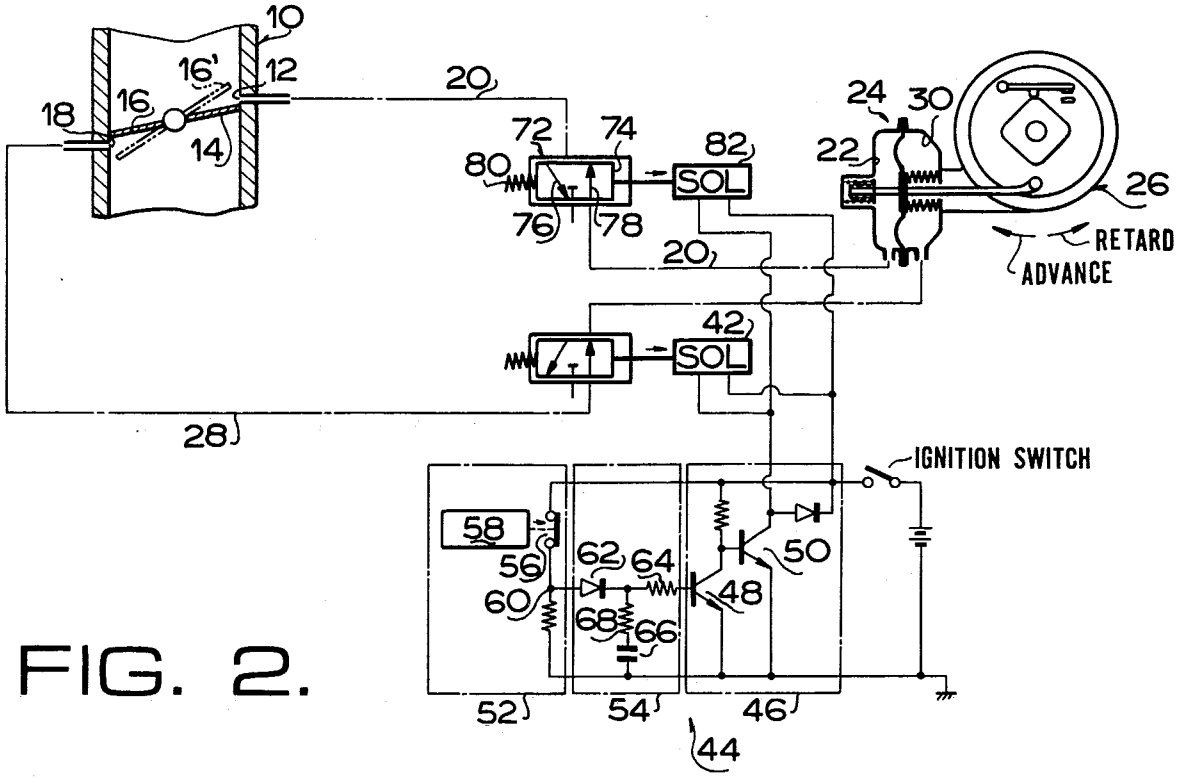

The other objects, features and advantages of the present invention will become apparent from the following description in connection with the drawings, in which:

FIG. 1 is a schematic view of an internal combustion engine according to a first embodiment of the present invention; and FIG. 2 is a similar view to FIG. 1 showing a second embodiment of the present invention.

Referring now to the accompanying drawings, the same reference numerals are used throughout the two views to designate like parts.

Referring particularly to FIG. 1, a carburetor 10 having an intake passageway is provided with a spark advance port 12. The spark advance port 12 is positioned adjacent to, and at the atmosphere side of a throttle valve 14 when the throttle valve 14 is closed in idle speed position (illustrated in solid line and designated as 16) and at the vacuum side of the throttle valve 14 when the throttle valve is partly opened to dotted line position 16'. The carburetor 10 is also provided with a spark retard port 18 which is positioned adjacent to, and on the vacuum side of the throttle valve 14 when the throttle valve is closed in idle speed position 16 and at the atmosphere side of the throttle valve 14 when the throttle valve is partly opened to the dotted line position 16'.

A vacuum conduit 20 connects the spark advance port 12 with a spark advance side chamber 22 of a suction device 24 in a distributor 26, while a vacuum conduit 28 connects the spark retard port 18 with a spark retard side chamber 30 of the suction device 24 through a gate in the form of a valve 32. The valve 32 is provided with a slidable valve 34 having a straight through passage 36 and a vent passage 38. A spring 40 normally positions the valve 34 to a position as shown to connect the spark retard port 18 with the spark retard side chamber 30 through the vacuum line 28 when a solenoid 42 is de-energized. The solenoid 42 when energized moves the valve 34 to a position to vent the passage 28. The solenoid 42 is connected to a control circuit 44.

The control circuit 44 comprises a switching circuit 46 including two transistors 48 and 50. The switching circuit 46 is designed such that the solenoid 42 remains de-energized as long as the transistor 48 is energized.

The control circuit 44 comprises a comparator circuit 52 and a delay circuit 54 as well. The comparator circuit 52 has a normally closed switch 56 that is opened when the engine speed sensed by an engine speed sensor 58 is higher than a predetermined reference engine speed. The comparator circuit 52 is designed such that when the engine speed is lower than the predetermined reference engine speed a voltage is imposed on a junction 60 and when the engine speed is higher than the predetermined reference engine speed the voltage on the junction 60 is zero. The junction 60 is connected to the base of the transistor 48 through a diode 62 and a resistor 64. The delay circuit 54 has a capacitor 66 with its one terminal grounded and the opposite terminal connected to a junction between the diode 62 and the resistor 64 through a resistor 68.

The operation of the system is as follows.

Assuming now that the engine speed is lower than the predermined reference engine speed and the throttle valve 14 is closed or partly opened less than the dotted line position 16: the switch 56 remains closed, the transistor 48 is energized while the transistor 50 de-energized, keeping the solenoid 42 de-energized, and the capacitor 66 is fully charged. Therefore the valve 34 is in the illustrated position to connect the spark retard port 18 to the chamber 30. Since in this condition the vacuum at the spark advance port 12 is negligible and the vacuum at the spark retard port is high, the spark retards.

Assuming that the engine speed is higher than the predetermined reference engine speed and the throttle valve 14 is opened wider than the dotted line position 16; the vacuum at the spark advance port 12 increases and the solenoid 42 is energized to keep the valve 34 to a position to vent the chamber 30. Thus the spark advances.

When the throttle valve 14 is opened wider than the dotted line position 16' for acceleration, the vacuum at the vacuum advance port 12 increases, while the vacuum at the spark retard port 18 decreases. When, in this condition, the engine speed exceeds the predetermined reference engine speed, the switch 56 is opened and the voltage at the junction 60 becomes zero. Then the current is discharged from the capacitor 66 and the transistor 48 is kept energized for a predetermined time after the engine speed has exceeded the predetermined reference engine speed.

If the engine speed increases above and decreases below the predetermined reference engine speed before the predetermined time passes, the voltage is again imposed to the junction 60 during discharge operation of the capacitor 66, so that the transistor 48 is kept energized to maintain the valve 34 in the illustrated position to connect the spark retard port 18 to the chamber 30.

It should be noted that the chamber 30 is kept connected to the spark retard port 18 to bias the spark toward the retarded setting until the predetermined time passes after the opening of the switch 56. Therefore it will be appreciated that according to the present invention during the transition period from the engine operation at low engine speed to the engine operation at high engine speed, the spark retard control is maintained during the engine operation in the neighborhood of the predetermined reference engine speed, contributing to the reduction of exhaust emissions.

Although in the system shown in FIG. 1 the suction device 24 is of the double action type, the present invention applied to an internal combustion engine with a spark vacuum retard control only.

Referring now to FIG. 2, an internal combustion engine is similar to that of FIG. 1 except that a second valve 72 is fluidly disposed in a conduit 20 intermediate a spark advance port 12 and a spark advance side chamber 22 of a suction device 24 in a distributor 26. The valve 72 is provided with a slidable valve 74 having a straight through passage 76 and a vent passage 78. A spring 80 normally positions the valve 74 to a position as shown to connect the chamber 22 to atomospheric pressure when a solenoid 82 is de-energized. The solenoid 82 when energized moves the valve 74 so as to a position to connect the chamber 22 to the spark advance port 12. The solenoid 82 is connected in a control circuit 44 such that it is energized or de-energized in response to energization or de-energization of a solenoid 42, as will be readily understood.

It will now be appreciated from the preceding description that according to the present invention the exhaust emission continues reduced during the transitional operation in the neighborhood of the predetermined reference engine speed.

What is claimed is:

1.

A spark timing control system for internal combustion engines, comprising a distributor, a vacuum means operatively connected to said distributor for actuation of the latter to advance and retard spark timing, said vacuum means including an operative spark retard chamber, a carburetor intake passageway, a throttle valve closeably and openably mounted in said intake passageway defining a vacuum side and an atmospheric side, respectively, conduit means connecting said intake passageway with said spark retard chamber of said vacuum means, said conduit means communicating with said intake passageway at the vacuum side of said throttle valve when said throttle valve is closed in an idle position and communicating at the atmospheric side of said throttle valve when said throttle valve is partly opened, valve means disposed in said conduit means intermediate said intake passageway and said spark retard chamber for selectively communicating said intake passageway with said spark retard chamber constituting a communicating condition and for venting said conduit means constituting a venting condition, respectively, a solenoid means for operating said valve means in response to a predetermined signal to change said valve means over from said communicating condition to said venting condition, switching means for supplying said predetermined signal to said solenoid means for said venting condition in response to a switching signal, said switching means comprises a transistor circuit, means for supplying said switching signal to said switching means comprising a comparator circuit and a delay circuit, the latter being connected operatively to said comparator circuit and to said transistor circuit, said delay circuit comprises a diode and a first resistor connected to each other, the latter connected to an input of said transistor circuit, as well as a capacitor and a second resistor connected to each other in series, one end of said second resistor being connected at a point between said diode and said first resistor, said comparator circuit includes a normally closed switch and a third resistor connected to each other at a junction, the latter being connected to a free side of a diode, as well as an engine speed sensor means for opening said normally closed switch when the engine speed exceeds said predetermined level, means for supplying a potential to said transistor circuit, said delay circuit and to said comparator circuit.

2. The system, as set forth in claim 1, wherein said transistor circuit comprises a first transistor having its base connected to said first resistor, and a second transistor having its base connected to said first transistor, and said second transistor is connected to said solenoid means.

3. The system, as set forth in claim 1, wherein in combination therewith said vacuum means defines a spark advance chamber operatively cooperating with said spark retard chamber, second conduit means connects said intake passageway with said spark advance chamber, said second conduit means communicates with said intake passageway at the atmospheric side of said throttle valve when said throttle valve is closed in the idle position and communicates at the vacuum side of said throttle valve when said throttle valve is partly opened, second valve means disposed in said second conduit means intermediate said intake passageway and said spark advance chamber for selectively venting said second conduit means and for communicating said intake passageway with said spark advance chamber, respectively, a second solenoid means for causing said second valve means to normally vent said second conduit means and for operating said second valve means to communicate said intake passageway with said spark advance chamber in response to the supplying of said predetermined signal to said first valve means.

* * * * *